US005198631A

United States Patent [19]

Hogue et al.

[11] Patent Number: 5,198,631

[45] Date of Patent: Mar. 30, 1993

[54] PRESSURE RESPONSIVE CONTROL DEVICE

[75] Inventors: Ronald L. Hogue, Morrison; James P. Frank, Rock Falls; Donald E. Nice, Morrison, all of Ill.

[73] Assignee: General Electric Company, Fort Wayne, Ind.

[21] Appl. No.: 757,821

[22] Filed: Sep. 11, 1991

[51] Int. Cl.[5] ..... H01H 35/34

[52] U.S. Cl. ..... 200/83 P; 73/723; 200/835; 200/303

[58] Field of Search ..... 92/5 R, 103 M; 307/118; 340/626; 337/318-320, 343, 365; 73/861.47, 715, 717, 723; 200/302.1, 303

[56] References Cited

U.S. PATENT DOCUMENTS

| | | | |
|---|---|---|---|
| 2,779,828 | 1/1957 | Despard . | |
| 3,378,656 | 4/1968 | Johnson . | |
| 3,419,692 | 12/1968 | Palen . | |
| 3,444,341 | 5/1969 | Mighton | 200/82 |
| 3,515,832 | 6/1970 | Martin . | |
| 3,531,607 | 9/1970 | Donahue et al. . | |
| 3,564,977 | 2/1971 | Davis | 92/101 |
| 3,665,373 | 5/1972 | Voglesonger . | |
| 3,673,546 | 6/1972 | Green et al. . | |
| 3,720,090 | 3/1973 | Halpert et al. | 73/4 R |
| 3,764,763 | 10/1973 | Barnes . | |
| 3,789,171 | 1/1974 | Kent . | |
| 3,816,685 | 6/1974 | Fiore . | |
| 3,848,517 | 11/1974 | Hawke . | |
| 3,876,845 | 4/1975 | Griffith et al. . | |
| 3,889,077 | 6/1975 | Hayashi | 200/61.25 |
| 3,890,477 | 6/1975 | Saunders | 200/83 P |
| 3,898,405 | 8/1975 | Weber . | |
| 3,911,238 | 10/1975 | Otto et al. . | |
| 3,916,149 | 10/1975 | Skinner . | |
| 3,963,889 | 6/1976 | Stonich | 200/81.9 R |
| 3,983,351 | 9/1976 | Bauer | 200/83 R |
| 3,984,649 | 10/1976 | Bauer et al. . | |
| 4,007,344 | 2/1977 | Hipple . | |
| 4,037,317 | 7/1977 | Bauer et al. . | |
| 4,081,636 | 3/1978 | Rice . | |
| 4,091,249 | 5/1978 | Huffman . | |
| 4,104,495 | 8/1978 | Jones et al. . | |
| 4,121,073 | 10/1978 | Bileski et al. . | |
| 4,145,587 | 3/1979 | Purssell . | |
| 4,168,415 | 9/1979 | Edwards, Jr. et al. . | |
| 4,172,412 | 10/1979 | Sepso . | |
| 4,195,209 | 3/1980 | Mlyniec . | |
| 4,200,776 | 4/1980 | Poling . | |
| 4,202,081 | 5/1980 | Johnston | 29/25.41 |
| 4,214,137 | 7/1980 | Hartley . | |

(List continued on next page.)

FOREIGN PATENT DOCUMENTS

| | | |
|---|---|---|
| 244290 | 11/1987 | European Pat. Off. . |
| 1028252 | 5/1966 | United Kingdom . |

*Primary Examiner*—Gerald P. Tolin
*Attorney, Agent, or Firm*—Ralph E. Krisher, Jr.

[57] ABSTRACT

A pressure sensitive control device having a housing made up of a plurality of housing members, a diaphragm, a bistable snap-disc, a switch and an actuator. The snap-disc moves from one configuration to another upon application of pressure over a predetermined amount to drive the actuator which moves the switch from its normal operating position, which can be either closed or open, to a tripped position, which is opposite its normal operating position. Two adjacent housing members, which support the snap-disc and switch, respectively, are formed with cooperating spacers which allow the spacing of these housing members to be continuously varied over a small range of adjustment to allow the switch point of the control device to be adjusted after partial assembly of the control device. The diaphragm and some of the housing members may be subassembled for testing the components of the control device prior to complete assembly. The switch is initially formed as one piece and electrically halved after subassembly with one of the housing members. A housing member which is formed for connection to an electrical control circuit to which the control device is to be attached is modular and can be replaced with similar housing members which are configured for connection to different types of mating electrical connectors associated with different control circuits.

Methods of assembly are also enclosed.

17 Claims, 4 Drawing Sheets

U.S. PATENT DOCUMENTS

| | | | |
|---|---|---|---|
| 4,215,254 | 7/1980 | Ohki . | |
| 4,220,836 | 9/1980 | Hersey | 200/83 P |
| 4,243,858 | 1/1981 | Place . | |
| 4,272,660 | 6/1981 | Mayer et al. . | |
| 4,282,476 | 8/1981 | Frezzolini et al. . | |
| 4,287,780 | 9/1981 | Poling . | |
| 4,296,287 | 10/1981 | Boulanger et al. . | |
| 4,306,127 | 12/1981 | Payne . | |
| 4,328,406 | 5/1982 | Evans et al. . | |
| 4,330,695 | 5/1982 | Poling . | |
| 4,339,638 | 7/1982 | Lascelles et al. . | |
| 4,342,887 | 8/1982 | Sanford . | |
| 4,343,974 | 8/1982 | Hire et al. . | |
| 4,346,272 | 8/1982 | Stoll . | |
| 4,351,105 | 9/1982 | Poling . | |
| 4,356,365 | 10/1982 | Siiberg . | |
| 4,365,406 | 12/1982 | Neill et al. . | |
| 4,400,602 | 8/1983 | Kuromitsu et al. . | |
| 4,401,964 | 8/1983 | Payne . | |
| 4,446,614 | 5/1984 | Haag . | |
| 4,456,801 | 6/1984 | Lauritsen et al. . | |
| 4,458,117 | 7/1984 | Johnson . | |
| 4,459,444 | 7/1984 | Charboneau . | |
| 4,464,551 | 8/1984 | Johnson . | |
| 4,469,923 | 9/1984 | Charboneau | 200/83 P |
| 4,473,729 | 9/1984 | Ting et al. . | |
| 4,479,039 | 10/1984 | Payne . | |
| 4,493,957 | 1/1985 | Watters . | |
| 4,495,389 | 1/1985 | Place . | |
| 4,510,763 | 4/1985 | Johnson . | |
| 4,532,389 | 7/1985 | Woods . | |
| 4,573,398 | 3/1986 | Johnson et al. | 92/101 |
| 4,581,509 | 4/1986 | Sanford et al. . | |
| 4,590,670 | 5/1986 | Payne . | |
| 4,591,677 | 5/1986 | Hirota et al. . | |
| 4,593,166 | 6/1986 | Hirota et al. . | |
| 4,616,114 | 10/1986 | Strasser . | |
| 4,626,636 | 12/1986 | Hickman et al. . | |
| 4,638,721 | 1/1987 | Boulanger | 92/6 D |
| 4,644,116 | 2/1987 | Miyakawa . | |
| 4,667,069 | 5/1987 | Cholkeri . | |
| 4,703,140 | 10/1987 | Poling . | |
| 4,720,759 | 1/1988 | Tabei . | |
| 4,731,510 | 3/1988 | Nourry . | |
| 4,737,604 | 4/1988 | Piesche et al. . | |
| 4,755,638 | 7/1988 | Geberth, Jr. . | |
| 4,757,165 | 7/1988 | Marcoux et al. . | |
| 4,761,525 | 8/1988 | Stumpff et al. . | |
| 4,777,978 | 10/1988 | Hsiao . | |
| 4,778,963 | 10/1988 | Guillou et al. . | |
| 4,783,580 | 11/1988 | Bassin . | |
| 4,794,214 | 12/1988 | Sanford . | |
| 4,804,808 | 2/1989 | Dal Cero . | |
| 4,827,094 | 5/1989 | Tanaka et al. . | |
| 4,845,322 | 7/1989 | Iwakiri et al. . | |
| 4,853,504 | 8/1989 | Tanaka et al. . | |
| 4,855,545 | 8/1989 | Kreuter . | |
| 4,891,479 | 1/1990 | Davis . | |
| 4,931,604 | 6/1990 | Poling . | |
| 4,939,321 | 7/1990 | Tanaka et al. . | |
| 4,947,544 | 8/1990 | Iwakiri et al. . | |
| 4,948,931 | 8/1990 | Nixon et al. . | |
| 4,967,047 | 10/1990 | Betterton et al. . | |
| 4,990,728 | 2/1991 | Joyce . | |
| 4,998,087 | 2/1991 | Boulanger . | |
| 5,001,317 | 3/1991 | Atkinson et al. . | |
| 5,004,873 | 4/1991 | Schnut | 200/83 P |
| 5,004,876 | 4/1991 | Sogge et al. . | |
| 5,015,808 | 5/1991 | Czarn | 200/834 |
| 5,049,708 | 9/1991 | Baker . | |

PRESSURE RESPONSIVE CONTROL DEVICE

BACKGROUND OF THE INVENTION

This invention relates generally to an electrical circuit control device and more particularly to fluid pressure actuated control device and a method of assembling such a control device.

Fluid pressure sensitive control devices typically include a housing having an opening for the communication of fluid pressure into the housing and a diaphragm which moves in response to the fluid pressure. A two position, bistable, snap-acting disc in the housing is movable, for example, from a generally convex configuration to a generally concave configuration upon application of sufficient pressure to the snap-disc from the diaphragm for actuating a switch in the housing to open or to close an electrical circuit to which the control device is attached. The snap-disc moves back to its convex configuration when the pressure applied by the diaphragm falls below a certain predetermined value. Control devices of the type to which this invention generally relates are used in automotive air conditioning systems to control the energization and deenergization of a clutch actuated compressor in response to a preselected low and high value of fluid pressure measured at a preselected point in the system, such as in an accumulator in the system. Examples of control devices of the same general type as disclosed herein are disclosed in Poling, U.S. Pat. No. 4,200,776, and Johnson, U.S. Pat. No. 4,464,551, which are incorporated herein by reference.

The control device is constructed so that the switch is either opened or closed by action of the snap-disc upon the detection of a predetermined level of pressure in the fluid system. In either case, the control device should be set so that the switch point, that is, the instant when the switch first makes or breaks contact to shut or open the electrical circuit occurs when the snap-disc is between its convex and concave configurations. Should the switch point be too near the convex or concave configuration of the snap-disc, the switch tends to oscillate between its open and closed positions because of small movements of the snap-disc caused by a slow pressure build-up (or relief) in the control device. Most signficantly, operating temperature conditions encountered by the control device and wear of parts over the life of the control device causes the switch point to drift toward the concave orientation of the snap-disc. Therefore, it is necessary to set the switch point nearer the convex position of the snap-disc to allow for this drift.

In production of control devices, properly setting the switch point is difficult because of the variations in component part sizes naturally arising from manufacturing tolerances for those parts. Presently, the switch point is set by attempting to hold part tolerances within limits which will result in the switch point being in one of an acceptable range of positions between the convex and concave configurations of the snap-disc. In some existing control devices, a one-way adjustment of the switch point can be made by fixing a pin in a position to engage a movable switch blade of the switch for applying a force to the switch blade in a direction opposite the force transmitted to the switch blade from the snap-disc. The application of this force by the pin adjusts the location of the switch point. Setting the switch point is a delicate procedure involving only a small range of appropriate positions of the pin. An important disadvantage of this approach is that the pin can only be moved in one direction, toward the switch blade. Thus, an overcorrection of the switch point cannot be remedied. In addition, this approach causes the switch blade to be subject to increased stress, thereby reducing its operating life.

Control devices must have the appropriate connection to the particular electrical control circuit to which they are to be attached. While the interior workings of the control device may be the same for various types of control circuits, changing the connector portion of the device requires a considerable expenditure of time and money because the housing is formed as one piece. Moreover, prior control devices do not allow the device to be tested prior to complete assembly. Thus, a defective diaphragm is not discovered until the device has been completely assembled, requiring that the device either be disassembled or discarded in its entirety.

Further difficulties in assembly of existing control devices occur because the switch is assembled as two separate pieces, one of which is a movable switch blade and the other of which is a stationary contact support having a contact engageable by a contact on the switch blade to close the switch. Although separation of the switch blade and the contact support is necessary in the device so that completion of the electric circuit is made only when the contact on the switch blade engages the contact on the contact support, the additional separate parts complicates and slows down assembly of the control device. In addition, proper alignment of the contact on the stationary contact support and the contact on the switch blade is difficult to attain.

SUMMARY OF THE INVENTION

Among the several objects and features of the present invention may be noted the provision of a control device constructed from standard components which may be easily and precisely adjusted to vary the switch point; the provision of such a control device which can be easily reconfigured for connection to different types of electrical connectors; the provision of such a control device which is readily capable of subassembly for testing component parts; the provision of such a control device which may be quickly assembled from fewer component parts; the provision of such a control device which can be easily and quickly assembled with the contacts of the switch in alignment; and the provision of such a control device employing component parts which are simple in design, and economically manufactured.

Further among the several objects and features of the present invention may be noted the provision of a method of assembling a control device which produces a subassembly prior to completion which can be tested; the provision of such a method of assembly which allows the control device to be configured for connection to different electrical connectors by replacement of one modular component thereof; the provision of such a method of assembly which can be accomplished quickly and accurately.

In general, a control device constructed according to the principles of the present invention comprises a housing having a cavity therein and a central longitudinal axis, the housing including first and second housing members having openings therein defining a portion of the cavity. The housing members are generally adjacent each other and selectively positionable relative each other generally axially of the housing at locations from a first position in which the first and second housing members are closest together, to a second position in which the first and second housing members are furthest apart. A diaphragm disposed in the cavity divides the cavity into a pair of chambers, and a control port in one end of the housing opens into one of the chambers for communicating fluid pressure into the one chamber. A snap-action member operable between a first and a second configuration is supported by the housing in the cavity, and spans at least in part across the other chamber. The snap-action member is adapted movement conjointly with the first housing member. A pair of terminal means are mounted in the housing generally adjacent the end of the housing opposite the control port. Switch means is disposed in the cavity and movable conjointly with the second housing member such that the selected spacing between the first and second housing members corresponds to the spacing between the switch means and the snap-action means. The switch means includes a resilient switch blade electrically connected to one of the terminal means and a stationary contact support portion electrically connected to the other terminal means. The switch blade is adapted for motion between a closed position in which the switch blade engages the contact portion and an open position in which the switch blade does not engage the contact portion. The switch blade is biased in a normal operating position selected from one of the closed and open positions. Interposed between the snap-action member and the switch blade and movable generally axially of the housing upon operation of the snap-action member toward the second configuration is actuator means for moving the switch blade between the normal operating position in which the switch blade is in one of the open and closed positions and a trip position in which the switch blade is in the other of the open and closed positions.

In another aspect of the present invention, a control device having a diaphragm, snap-action member, switch means and actuator means as described above, wherein the housing includes an input housing member disposed generally at one end of the control device, a connector housing member disposed generally at the opposite end of the device and intermediate housing member disposed intermediate the input and connector housing members. Holding means comprising a tubular sleeve adapted to receive the intermediate housing member and at least a portion of the housing members therein. The sleeve is made of a plastically deformable material so that the sleeve may be deformed into engagement with at least one of the housing members after reception in the sleeve of the housing members for holding the housing members in substantially fixed relation relative one another.

Further in regard to the present invention, a control device having housing with a cavity and a central longitudinal axis, and a diaphragm, snap-action member, actuator means and switch means substantially as described above. The switch means described is initially formed as one piece and comprises a frangible portion connecting the switch blade and the stationary contact support portion upon formation of the switch means which is adapted to be broken after assembly of the switch means in the housing to break electrical connection between the switch blade and the contact portion.

Still further in regard to the present invention, a method of assembling a pressure responsive control device including the step of providing housing including an input housing member having a control port therein adapted to transmit fluid pressure into the housing, an intermediate housing member, and an electrical connector housing member adapted for connecting the control device to an electrical circuit exterior the control device. Means for holding the housing members together in a substantially fixed relationship relative each other, a diaphragm, switch means and actuating means for operating the switch means in response to movement of the diaphragm are also provided. The input housing member, diaphragm and intermediate housing member are secured with the holding means together in sealing relation to form a subassembly which is tested for leakage. To complete the assembly, the switch means, and the remaining housing members are secured with the holding means.

In yet another aspect of the present invention, a method of assembling a control device including steps of providing the housing members, diaphragm, holding means, switch means and actuating means as described above. Assembly is continued by securing together the housing members except the connector housing member with the holding means, with the diaphragm, the switch means and the actuating means being supported in the housing by the housing members. One electrical connector housing member is selected from a plurality of connector housing members, which connector housing member is constructed for connection to the particular control circuit. The selected connector housing member is then secured by the holding means in substantially fixed relation to the other housing members.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF A PREFERRED EMBODIMENT

Figure 1:
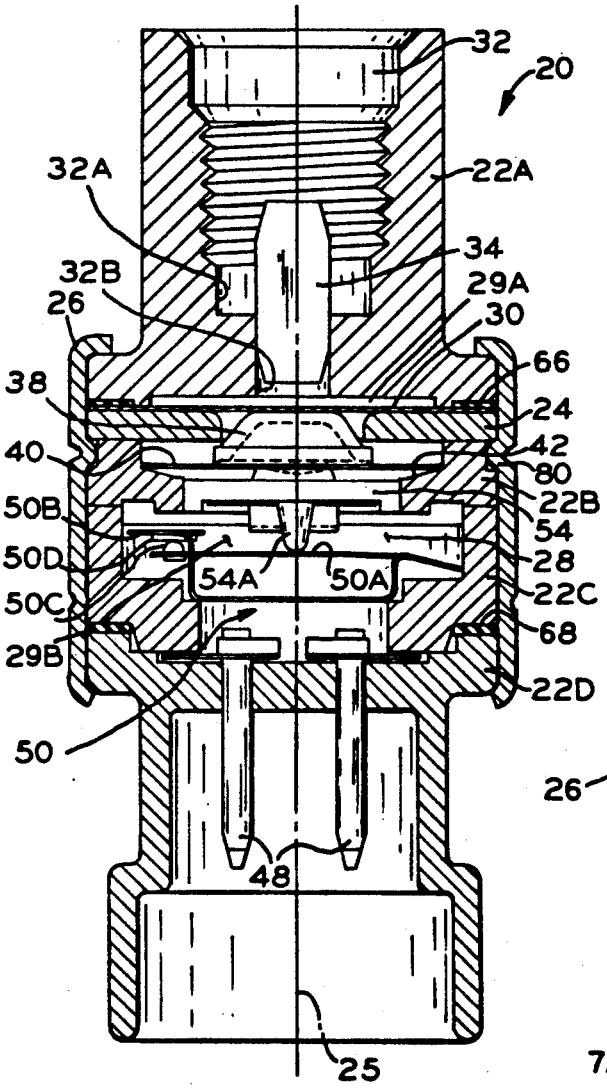
FIG. 1 is a longitudinal section of a control device of the present invention as assembled.

Referring now to the drawings and in particular to FIG. 1, a control device indicated generally at 20 is shown to include a housing formed from housing members 22A-22D and metal washer 24, and having a central longitudinal axis 25. The housing members 22A-22D and metal washer 24 are held together in substantially fixed relation relative each other in a tubular sleeve 26. More particularly, the housing members include an input nut 22A, an annular snap-disc support housing member 22B (broadly "first housing member"), a switch support housing member 22C (broadly "second housing member"), and an electrical connector housing member 22D. As assembled, the housing members 22A-22D and washer 24 define a cavity 28 extending longitudinally between the input nut 22A and the connector housing member 22D. A diaphragm 30 comprising a circular disc of flexible material such as plastic is clamped at its peripheral edge margins between the input nut 22A and the metal washer 24. The diaphragm 30 divides the cavity 28 into two chambers, the first chamber 29A being the thin space between the diaphragm 30 and the input nut 22A and the second chamber 29B being the remaining portion of the cavity 28 below (as seen in FIG. 1) the diaphragm. The input nut 22A has been counterbored to form a control port 32 having an outer section 32A formed with threads for connection to a fluid (i.e., gas or liquid) system such as an automotive air conditioning system (not shown), and a narrow inner section 32B which opens into the first chamber 29A for communicating fluid pressure from the system to the first chamber. A valve actuator 34 held in the inner section 32B of the control port is capable of engaging and actuating a check valve (not shown) of a fluid system for opening the check valve and allowing fluid to enter the control device 20.

Communication of fluid pressure from the fluid system to the first chamber 29A results in a pressure differential between the first and second chambers 29A, 29B across the diaphragm 30 which presses against an inverted, cup-shaped force transmitting member 38 located between and engaging the diaphragm and a snap-disc 40 (broadly "snap-action member"). The snap-disc 40 is circular and supported at its peripheral edge margins by an annular ledge 42 in the snap-disc support housing member 22B such that the snap-disc spans across the second chamber 29B of the cavity. The snap-disc 40 is operable between two configurations, a convex (or "first") configuration in which the disc bows outwardly away from the switch support housing member 22C, and a concave (or "second") configuration in which the snap-disc bows inwardly toward the switch support housing member 22C.

Figure 2:
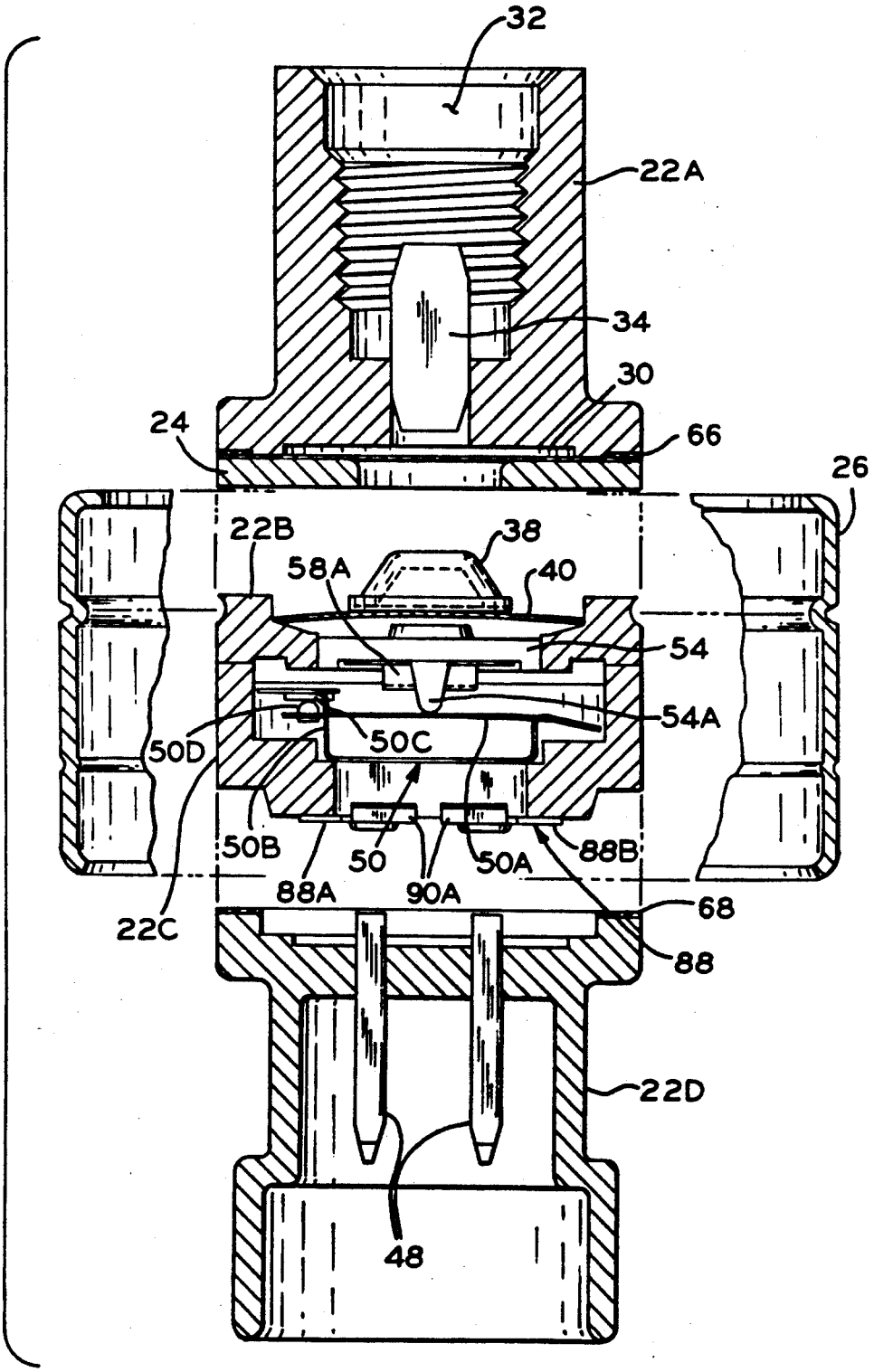
FIG. 2 is an exploded longitudinal section of the control device illustrating its assembly.
Figure 9:
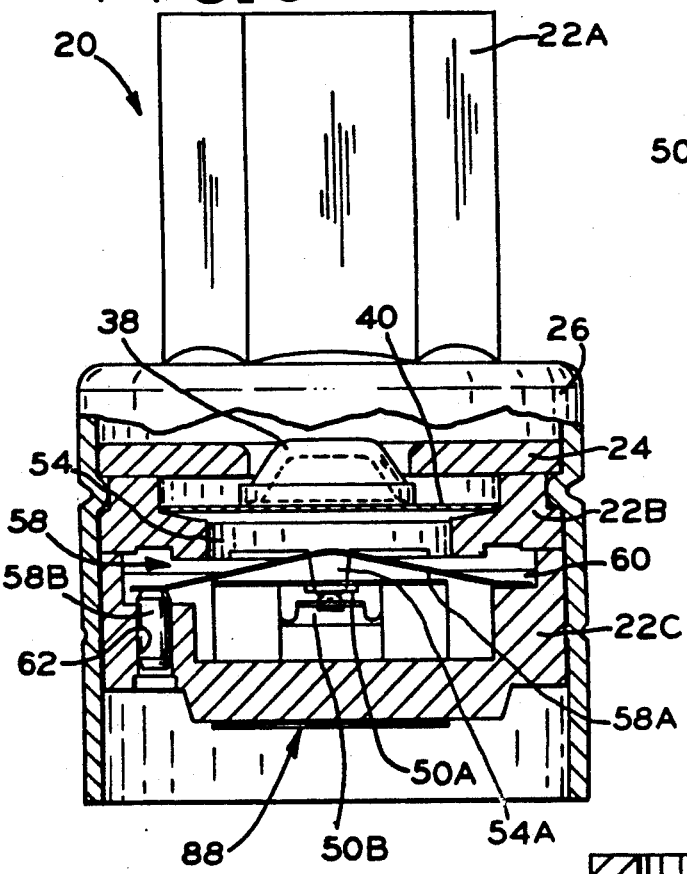
FIG. 9 is an elevation of the control device turned 90 degrees from its position in FIG. 1, with part of the device broken away to show details.
Figure 11:
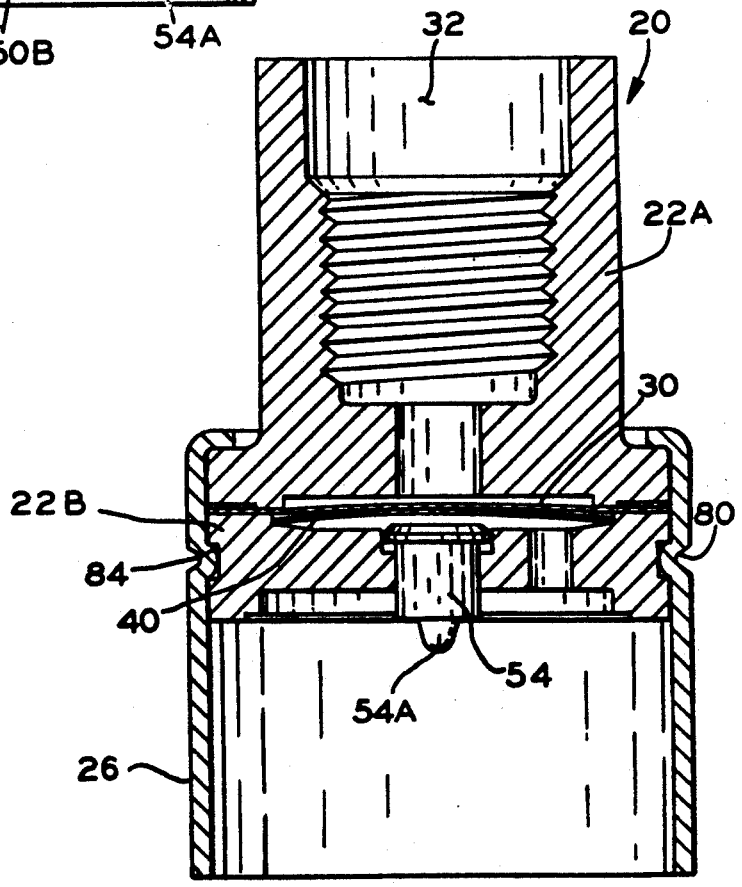
FIG. 11 is a control device of a second embodiment of the present invention for use in low pressure applications.

The snap-disc is shown in its convex configuration in FIGS. 2 and 11, and in unstable configuration intermediate its convex and concave configuration in FIGS. 1 and 9. Movement of the snap-disc 40 from the convex configuration to the concave configuration is produced by the application of pressure to the snap-disc from the diaphragm 30 through the force transmitting member 38. The metal washer 24 and force transmitting member 38 operate to proportionately reduce the force applied to the snap-disc 40 as a result of the pressure in the first chamber 29A. It is to be understood that other snap-action devices, including but not limited to an annular snap action member or Belleville spring, or a spider or spoke type snap-action member may be used and still fall within the scope of the present invention. The ledge 42 is generally frustoconically shaped, sloping toward the switch support housing member 22C away from the periphery of the ledge to facilitate the movement of the snap-disc 40 to its concave configuration. However, the control device will function with the ledge 42 having shapes other than frustoconical.

Figure 7:
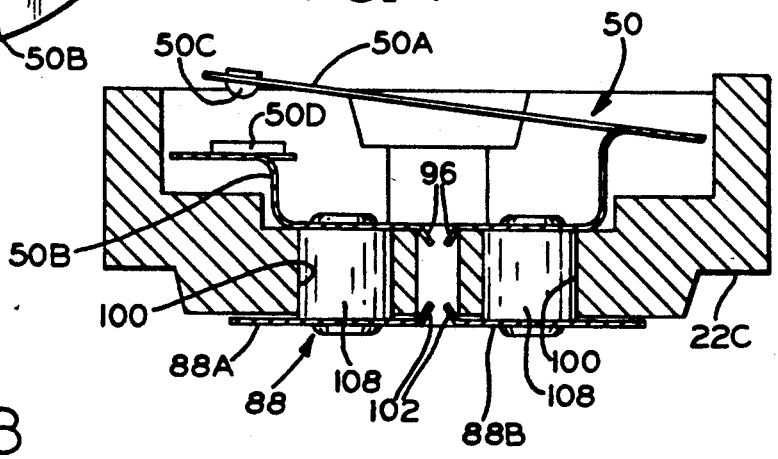
FIG. 7 is a longitudinal section of the second housing member showing a switch of a second configuration as supported therein.

A pair of terminal pins 48 are mounted on and extend through the inner end of the electrical connector housing member 22D. The opposite end of the connector housing 22D is open for receiving an electrical connector of a control circuit of apparatus (not shown) to be controlled by the control device (e.g., the compressor of an automotive air conditioning system). The type of connector housing 22D required may differ depending upon the specific type of electrical connector to which the control device 20 must be connected. As explained more fully below, the control device of the present invention is constructed for quick and easy changeover to accommodate different types of electrical connectors. A switch 50 held in the switch support housing member 22C includes a resilient switch blade 50A and a stationary contact support portion 50B. The switch blade 50A is a cantilevered arm extending across the second chamber 29B and has a contact 50C at its free end aligned with a contact 50D on the stationary contact support portion 50B. The switch blade is permanently electrically connected to one of the terminal pins 48, and the contact support portion 50B is permanently electrically connected to the other terminal pin. To selectively achieve electrical connection between the terminal pins 48, thereby completing the electrical circuit to which the control device is attached, the switch blade 50A is movable between an open position in which the outer end of the switch blade is spaced from the contact support portion and the contacts 50C, 50D are not engaged, and a closed position in which the contact 50C of the switch blade engages the contact 50D of the contact support portion. The switch 50 has a normal operating position which is either closed (as shown in FIG. 1), or open (as shown in FIG. 7). In either case, the switch blade 50A is biased by its own resiliency toward the normal operating position.

A disc-shaped actuator 54 is slidably received in the snap-disc support housing member 22B for movement axially of the housing. A finger 54A of the actuator 54 projects toward and engages the switch blade 50A of the switch, and the opposite end of the actuator engages the snap-disc 40. The actuator 54 moves toward the switch upon the operation of the snap-disc to its concave configuration, with the finger 54A pushing the switch blade 50A away from its normal operating position in which the switch 50 is either opened or closed, to a trip position in which the switch is in the opposite position. The snap-disc 40 is operable to its concave configuration only when the pressure transmitted from the diaphragm 30 through the force transmitting member 38 to the snap-disc reaches or exceeds a certain predetermined value. As illustrated in FIGS. 1 and 9, the snap-disc 40 is in an unstable configuration corresponding to the point where the actuator 54 causes the switch blade 50A to break the engagement of the contacts 50C, 50D (i.e., the "switch point").

In the control device 20 described herein, the pressure value triggering operation of the snap-disc 40 may be increased upon assembly about 2 psi to 30 psi from the natural sensitivity pressure of the snap-disc. However, the precise range of pressure sensitivity variation may be other than 2–30 psi and still fall within the scope of the present invention. Pressure sensitivity of the control device may be adjusted with a spring regulator 58 (FIG. 9) including a thin, inverted V-shaped spring 58A having an opening in its center through which is received the finger 54A of the actuator 54. The spring 58A biases the actuator upwardly against the snap-disc 40 thereby increasing the pressure necessary to operate the snap-disc from its convex configuration to its concave configuration. Referring to FIG. 9, the spring 58A is supported at its right end in a recess 60 formed in the switch support housing member 22C, and at its left end on a set pin 58B held by a friction fit in a hole 62 through the switch support housing member. The biasing force the spring 58A exerts against the actuator 54 and hence against the snap-disc 40 may be set after assembly in the sleeve 26 by fixing the set pin 58B in the hole 62 with a selected amount of the set pin extending inwardly into the second chamber 29B from the hole. The further the set pin 58 extends from the hole 62, the closer it is to the snap-disc 40 and the greater the force exerted by the spring 58A against the actuator 54 and the snap-disc 40.

To seal the housing, the input nut 22A, diaphragm 30 and washer 24 are sealed with each other and with the sleeve 26 by a first annular gasket 66 received in an annular rabbet in the inner end of the input nut. The first gasket 66 is squeezed between the input nut 22A, and the diaphragm 30 and washer 24, and forced outwardly against the sleeve 26. A second annular gasket 68 is located between the switch support housing member 22C and the electrical connector housing member 22D for sealing between them and also sealing with the sleeve 26. The second gasket 68 serves to keep moisture and other contaminants out of the second chamber 29B of the housing.

Figure 4:
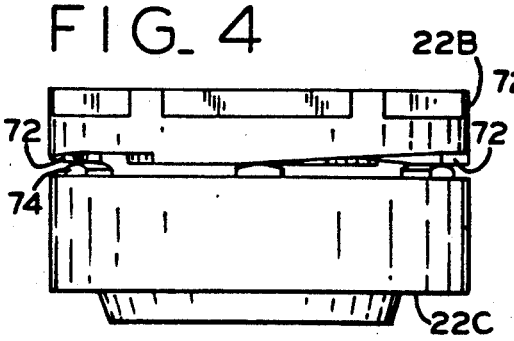
FIG. 4 is an elevation of first and second housing members of the control device.
Figure 5:
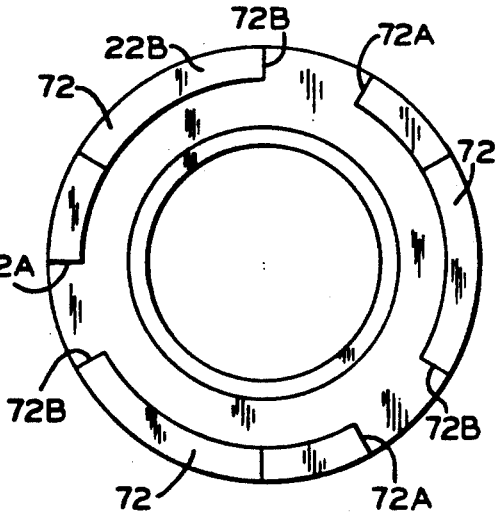
FIG. 5 is a bottom plan of the first housing member.

The control device 20 of the present invention is constructed to allow the switch point of the switch 50 to be set at one of a plurality of positions upon assembly of the control device. The switch point is determined by the separation of the snap-disc 40 from the switch blade 50A. To that end, the snap-disc support housing member 22B and the switch support housing member 22C are positionable relative each other axially of the housing. The snap-disc 40 and the switch 50 are movable conjointly with the snap-disc support housing member 22B and switch support housing member 22C, respectively. As shown in FIGS. 4 and 5, the snap-disc support housing member 22B is formed with three arcuate ramps 72 (broadly "first spacer means") extending along the periphery of the of the housing member. Each ramp 72 is an arcuate, elongate strip formed as one piece with the snap-disc support housing member 22B which projects outwardly from one end 72A of the ramp where the strip is generally flush with the peripheral edge margin of the snap-disc support housing member, to a position at an opposite end 72B of the ramp which is axially spaced from the peripheral edge margin of the housing member. In the preferred embodiment, three studs 74 (broadly "second spacer means") formed as one piece with the switch support housing member 22C are radially aligned for engagement with respective ramps 72. By changing the angular orientation of the snap-disc support housing member 22B and the switch support housing member 22C relative each other about the central longitudinal axis 25, the location of engagement of the studs 74 along the ramps 72 can be changed. As shown in FIG. 4, the housing members 22B, 22C are oriented so that the studs 74 rest on the portion of the ramp 72 furthest away from the remainder of the snap-disc support housing member so that maximum separation of the housing members is attained. The separation may be selectively reduced from that shown in FIG. 4 by turning the snap-disc support housing member 22B relative the switch support housing member 22C so that the studs 74 engage a different portion of the ramp closer to the snap-disc support housing member 22C. Minimum separation may be achieved by turning the housing members 22B, 22C so that the studs 74 engage the flat peripheral edge margins of the snap-disc support housing member 22B between the ramps 72.

It is envisioned that the means for adjusting the spacing between the snap-disc support housing member 22B and the switch support housing member 22C may take on other forms. For example, the studs 74 on the switch support housing member 22C may be replaced by ramps (not shown) similar to the ramps 72 on the snap-disc support housing member 22B. The ramps on the switch support housing member 22C would be constructed for cooperatively engaging the ramps 72 on the snap-disc support housing member 22B so that rotation of the housing members 22B, 22C relative each other would vary the separation of the housing members, and thus the switch point.

Figure 3:
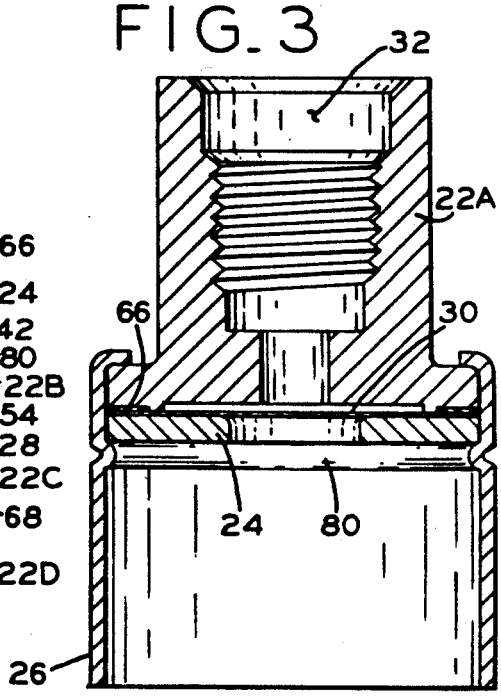
FIG. 3 is a longitudinal section of a subassembly of the control device.

Referring to FIG. 2, the control device 20 of the present invention is designed for quick and easy assembly, and changeover flexibility to produce a control device needed to fit into a particular fluid system. Moreover, the control device is assembled so that during the ordinary course of assembly, a subassembly may be formed and tested prior to completion of the control device assembly. The tubular sleeve 26 is made of a ductile material, such as aluminum, so that it may be crimped to engage and hold the housing members 22A–22D together in a generally fixed relation with respect to each other. In the preferred embodiment, the opening in one end of the tubular sleeve 26 is smaller than the opening in the other end. The input housing member 22A, first gasket 66, diaphragm 30 and metal washer 24 are inserted in that order through the larger opening at the opposite end of the tubular sleeve 26. For the high pressure configuration of the control device 20 shown in FIG. 3, the metal washer 24 constitutes an "intermediate housing member". The end of the sleeve 26 having the smaller opening retains these control device components in the sleeve with the input member 22A projecting axially out of the sleeve at the folded end. An annular crimp 80 is formed in the sleeve 26 which engages the washer 24 to form a subassembly of the input nut 22A, diaphragm 30 and washer (FIG. 4). The input nut 22A may then be attached to a fluid pressure source to test the diaphragm 30 and the seal of the first gasket 66 prior to complete assembly of the control device.

After testing the subassembly, assembly of the control device 20 continues by inserting the force transmitting member 38, snap-disc 40 and snap-disc support housing member 22B, and actuator 54 into the sleeve 26. The force transmitting member 38, snap-disc 40 and actuator 54 constitute "actuating means". These components are followed by the switch support housing member 22C preassembled with the switch 50. The switch support housing member 22C also carries the spring 58A and set pin 58B, for adjusting the pressure sensitivity of the control device upon assembly. At this time, the switch point of the control device may be set by rotating the snap-disc and switch support housing members 22B, 22C relative each other and repeatedly tripping the control device switch 50 until the switch point is appropriately set between the convex and concave configurations of the snap-disc 40. The second gasket 68 and the connector housing member 22D are then inserted into the sleeve 26. A second annular crimp 82 is formed in the sleeve 26 which engages and holds the switch support housing member 22C, and the end of the sleeve opposite the input nut is deformed against the electrical connector housing member 22D, thereby securing the housing members 22A-22D and other internal components. The precise order of many of the steps may be varied without departing from the scope of the invention.

An alternative configuration of the subassembly is shown in FIG. 11, which shows a subassembly of a control device used for low pressure (i.e., approximately less than 100 psi) applications. The control device shown in FIGS. 1-10 and discussed above is used for high pressure applications and includes the metal washer 24 and the force transmitting member 38 which operate to reduce the force transmitted from the diaphragm to the snap-disc 40. In the low pressure configuration, the washer 24 and force transmitting member 38 are omitted, and, thus, the "actuating means" includes only the snap-disc 40 and the actuator 54. The diaphragm 30 engages the snap-disc 40 so that force is transmitted directly by the diaphragm to the snap-disc. The actuator 54 is cylindrical, rather than disc-shaped as in the high pressure control device. The subassembly for testing the diaphragm 30 and first gasket seal includes the input nut 22A, the first gasket 66, the diaphragm, the snap-disc 40 and the snap-disc support housing member 22B. For the low pressure control device, the snap-disc support housing member 22B constitutes "intermediate housing member". The crimp 80 engages the snap-disc support housing member 22B in a circumferential channel 84 of the housing member to secure the subassembly shown in FIG. 11. Except for those components of the low pressure control device discussed above, the components of the low pressure control device are the same as for the high pressure device.

Figure 8:
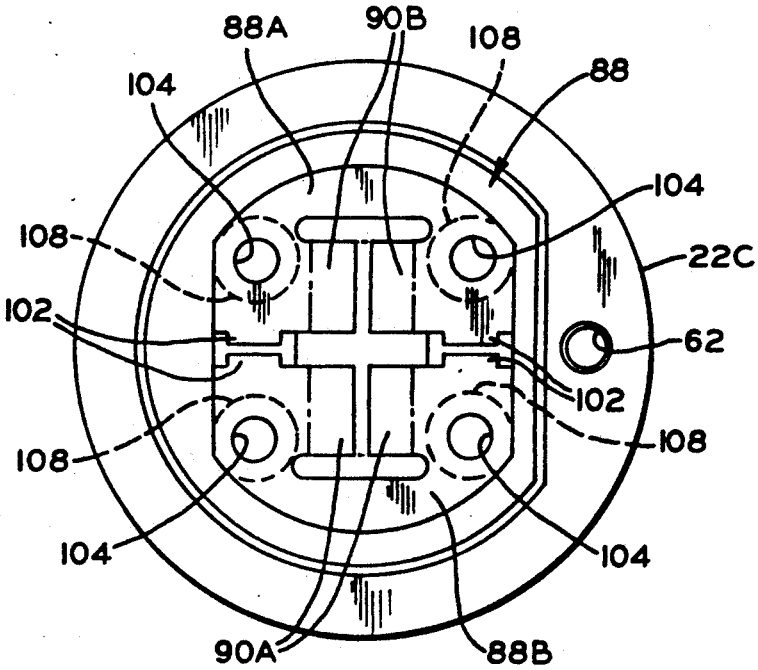
FIG. 8 is a bottom plan of the second housing member.

The electrical connector housing member 22D which is shown in the drawings is constructed to receive a particular type of electrical connector of the exterior electrical control circuit to which the control device is connected. However, different manufacturers of fluid systems frequently employ different electrical connectors. Changeover to a corresponding different electrical connector housing member (not shown) can be carried out by merely selecting the appropriate connector housing member 22D from a plurality of such connector housing members, inserting an end into the sleeve 26 and deforming the end of the sleeve against the housing member. Such changeover may be accomplished relatively inexpensively because the electrical connector housing member 22D is preassembled only with the terminal pins 48. Electrical connection of the pins 48 with the stationary contact support 50B and the switch blade 50A, respectively, is achieved upon insertion of the connector housing member 22D into the sleeve 26 through the provision of a terminal pin receptor 88 attached to the switch support housing member 22C (FIG. 8). The receptor 88 includes two electrically separate portions, each having an opposing pair of spring-acting terminal pin receiving flaps, indicated at 90A and 90B, respectively, with each terminal pin 48 being received between and contacting a pair of flaps. The terminal pin 48 pushes the flaps (90A or 90B) apart and away from their relaxed position so that the flaps are biased against the terminal pin to maintain electrical connection.

Figure 6:
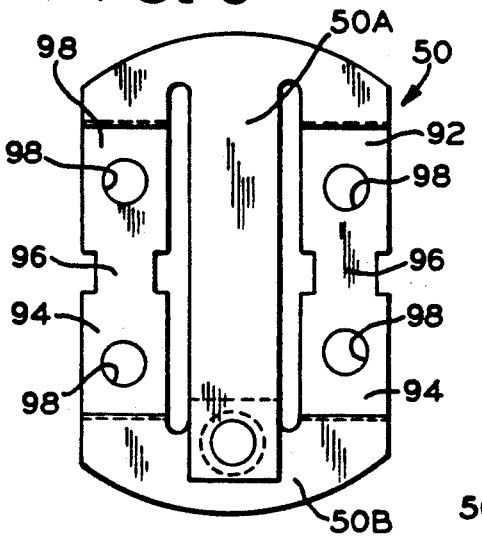
FIG. 6 is a top plan of a switch prior to assembly in the control device.
Figure 10:
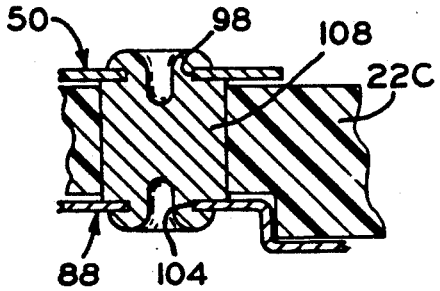
FIG. 10 is a fragmentary section of a connector pin in the second housing member.

The switch 50, and receptor 88, which are formed from an electrically conductive material such as beryllium copper, are preassembled with the switch support housing member 22C prior to assembly of the control device as described. As shown in FIG. 6, the switch 50 is initially formed as one piece including the stationary contact support portion 50B and the switch blade 50A. The switch blade 50A and the contact support portion 50B each have feet indicated at 92 and 94, respectively, which are connected by narrow frangible portions 96. The feet 92, 94 each have an opening 98 which is aligned with a corresponding opening 100 in the switch support housing member 22C upon assembly (FIG. 7) of the switch 50 with the housing member. The receptor 88 is also formed as a single piece with its two sections 88A, 88B connected by narrow frangible portions 102 (shown only after broken in FIG. 8). Openings 104 in the receptor 88 are capable of alignment with the openings 100 in the switch support housing member 22C. The switch 50 and receptor 88 are mounted on the switch support housing member 22C and electrically connected to each other by four pins 108 (one of which is shown in FIG. 10) received in the openings 100 in the switch support housing member. The ends of the pins 108 are tubular and may be crimped over against the switch 50 and receptor 88, respectively, to attach them to the switch support housing member 22C. This much of the preassembly is carried out with the switch 50 and receptor 88 still configured in single pieces. The frangible portions 96, 102 of the switch 50 and receptor 88 are then broken to break electrical connection between the switch blade 50A and contact support portion 50B of the switch, and the sections 88A, 88B of the receptor. Thus, preassembly of the switch 50, receptor 88 and switch support housing member 22C may be carried out with a lesser number of pieces. Formation of the switch 50 as a single piece helps to accurately locate the switch blade 50A and contact support member 50B relative each other so that proper alignment of the contacts 50C and 50D is achieved and maintained.

The effective length of the switch blade 50A is increased by the integral feet 92, which remain attached to the switch blade after the frangible portions 96 are broken. Therefore, the stress experienced by the switch blade 50A in operation is reduced over construction in which the switch blade is attached to a separate piece of rigid material (e.g., a brass post).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What we claim and desire to secure by Letters Patent of the United States is:

1. A control device comprising:

a housing having a cavity therein and a central longitudinal axis, the housing including first and second housing members having openings therein defining a portion of the cavity, said housing members being generally adjacent each other and selectively positionable relative each other generally axially of the housing at locations from a first position wherein said first and second housing members are closest together, to a second position in which said first and second housing members are furthest apart;

said first housing member including first spacer means and said second housing member including second spacer means, said first spacer means engaging said second spacer means at a location on said second spacer means selected from a range of possible locations of engagement, said first and second spacer means being constructed and arranged such that said selected location of engagement of said first spacer means with said second spacer means determines the axial position of the first and second housing members relative one another;

a diaphragm disposed in the cavity and dividing the cavity into a pair of chambers;

a control port in one end of the housing opening into one of said chambers, said control port being adapted for the communication of fluid pressure into said one chamber;

a bistable snap-action member operable between a first configuration and a second configuration supported by the housing in the cavity, and spanning at least in part across said other chamber, said snap-action member being adapted for movement conjointly with said first housing member;

a pair of terminal means mounted in the housing generally adjacent the end of the housing opposite the control port;

switch means disposed in the cavity and movable conjointly with said second housing member such that the selected spacing between said first and second housing members corresponds to the spacing between said snap-action means and said switch means, said switch means including a resilient switch blade electrically connected to one of said terminal means and a stationary contact support portion electrically connected to the other terminal means, said switch blade being adapted for motion between a closed position in which the switch blade engages said stationary contact support portion and an open position in which the switch blade does not engage said stationary contact support portion, said switch blade being biased in a normal operating position selected from one of said closed and open positions;

actuator means interposed between said snap-action member and the switch blade and movable generally axially of the housing upon operation of said snap-action member toward said second configuration for moving the switch blade between said normal operating position in which the switch blade is in one of said open and closed positions and a trip position in which the switch blade is in the other of said open and closed positions.

2. A control device as set forth in claim 1 wherein said first spacer means comprises at least one ramp connected to the first housing member, the axial spacing between said first housing member and said second housing member being determined by the angular orientation relative to one another of said first and second housing members about the central longitudinal axis of the housing.

3. A control device comprising:

a housing having a cavity therein and a central longitudinal axis, the housing including first and second housing members having openings therein defining a portion of the cavity, said housing members being generally adjacent each other and selectively positionable relative each other generally axially of the housing at locations from a first position wherein said first and second housing members are closest together, to a second position in which said first and second housing members are furthest apart;

a diaphragm disposed in the cavity and dividing the cavity into a pair of chambers;

a control port in one end of the housing opening into one of said chambers, said control port being adapted for the communication of fluid pressure into said one chamber;

a bistable snap-action member operable between a first configuration and a second configuration supported by the housing in the cavity, and spanning at least in part across said other chamber, said snap-action member being adapted for movement conjointly with said first housing member;

a pair of terminal means mounted in the housing generally adjacent the end of the housing opposite the control port;

switch means disposed in the cavity and movable conjointly with said second housing member such that the selected spacing between said first and second housing members corresponds to the spacing between said snap-action means and said switch means, said switch means including a resilient switch blade electrically connected to one of said terminal means and a stationary contact support portion electrically connected to the other terminal means, said switch blade being adapted for motion between a closed position in which the switch blade engages said stationary contact support portion and an open position in which the switch blade does not engage said stationary contact support portion, said switch blade being biased in a normal operating position selected from one of said closed and open positions;

actuator means interposed between said snap-action member and the switch blade and movable generally axially of the housing upon operation of said snap-action member toward said second configuration for moving the switch blade between said normal operating position in which the switch blade is in one of said open and closed positions and a trip position in which the switch blade is in the other of said open and closed positions;

said first housing member including first spacer means, and said second housing member including second spacer means, said first spacer means being engageable with said second spacer means for positioning said first and second housing members at a predetermined axial spacing, the spacing between said first housing member and said second housing member being determined by the angular orientation of said first and second housing members about the central longitudinal axis of the housing relative to one another;

said first and second housing members being generally annular, and wherein said first spacer means comprises at least one arcuate ramp formed as one piece with said first housing member and extending along the periphery of said first housing member.

4. A control device as set forth in claim 3 wherein said second spacer means comprises at least one stud formed as one piece with said second housing member and projecting axially outwardly from said second housing member, the stud being disposed generally at the periphery of said second housing member and engageable with the ramp, the spacing of said first and second housing members depending on the location of the stud on the ramp.

5. A control device as set forth in claim 3 comprising at least two of the ramps circumferentially spaced along the periphery of said first housing member by flat portions of said first housing member, each ramp comprising an elongate, arcuate strip extending outwardly from a position generally flush with said first housing member to a position axially spaced from said first housing member.

6. A control device as set forth in claim 1 wherein the housing further comprises a connector housing member having said terminal means mounted therein and being adapted for connecting the control device to an electrical circuit exterior of the control device, the control device further comprising means for holding said housing members together in a substantially fixed relation relative each other.

7. A control device as set forth in claim 6 wherein said holding means comprises a tubular sleeve adapted to receive at least a portion of said housing members therein, the sleeve being made of a plastically deformable material whereby the sleeve may be deformed into engagement with at least one of said housing members after reception in the sleeve of said housing members for holding said housing members in substantially fixed relation relative one another.

8. A control device as set forth in claim 1 wherein the housing further comprises an input housing member having the control port therein, the input housing member and said diaphragm being adapted to be held in the sleeve in a sealing, fixed relation relative each other, the input housing member and diaphragm subassembly thereby constructed being adapted for leak testing prior to completion of the assembly of the control device.

9. A control device comprising:

a housing having a cavity therein and a central longitudinal axis, the housing comprising a plurality of housing members including at least an input housing member disposed generally at one end of the control device, a connector housing member disposed generally at the opposite end of the device and an intermediate housing member disposed intermediate said input and connector housing members;

holding means comprising a tubular sleeve adapted to receive at least a portion of all of said housing members therein, the sleeve being made of a plastically deformable material and being deformed into engagement with at least one of said housing members after reception in the sleeve of said housing members for holding said housing members in substantially fixed relation relative one another;

a diaphragm disposed in the cavity and dividing the cavity into a pair of chambers;

the sleeve being deformed to hold the input housing member and diaphragm in sealing relation with each other separate and apart from the other housing members thereby forming a subassembly adapted for leak testing prior to completion of the assembly of the control device;

a control port in said input housing member opening into one of said chambers, said control port being adapted for the communication of fluid pressure into said one chamber;

a snap-action member operable between a first and a second configuration supported by the housing in the cavity, and spanning at least in part across said other chamber;

a pair of terminal means mounted in said connector housing member;

switch means disposed in the cavity, said switch means including a resilient switch blade electrically connected to one of said terminal means and a stationary contact support portion electrically connected to the other terminal means, said switch blade being adapted for motion between a closed position in which the switch blade engages said stationary contact support portion and an open position in which the switch blade does not engage said stationary contact support portion, said switch blade being biased in a normal operating position selected from one of said closed and open positions;

actuator means interposed between said snap-action member and the switch blade and movable generally axially of the housing upon operation of said snap-action member toward said second configuration for moving the switch blade between said normal operating position in which the switch blade is in one of said open and closed positions and a trip position in which the switch blade is in the other of said open and closed positions.

10. A control device as set forth in claim 9 wherein said housing comprises first and second housing members, said first housing member including first spacer means, and said second housing member including second spacer means, said first spacer means engaging said second spacer means at a location on said second spacer means selected from a range of possible locations of engagement, said first and second spacer means being constructed and arranged such that said selected location of engagement of said first spacer means with said second spacer means determines the axial spacing of the first and second housing members relative to one another, the spacing between said first housing member and said second housing member being determined by the angular orientation relative to one another of said first and second housing members about the central longitudinal axis of the housing, and wherein the snap-action member is movable conjointly with said first housing member and said switch means is movable conjointly with said second housing member such that the spacing between said first and second housing members corresponds to the spacing between the snap-action member and said switch means.

11. A control device comprising:

a housing having a cavity therein and a central longitudinal axis, the housing including at least an input housing member disposed generally at one end of the control device, a connector housing member disposed generally at the opposite end of the device and an intermediate housing member disposed intermediate said input and connector housing members;

holding means comprising a tubular sleeve adapted to receive at least a portion of said housing members therein, the sleeve being made of a plastically deformable material whereby the sleeve may be deformed into engagement with at least one of said housing members after reception in the sleeve of said housing members for holding said housing members in substantially fixed relation relative one another;

a diaphragm disposed in the cavity and dividing the cavity into a pair of chambers;

a control port in said input housing member opening into one of said chambers, said control port being adapted for the communication of fluid pressure into said one chamber;

a snap-action member operable between a first and a second configuration supported by the housing in the cavity, and spanning at least in part across said other chamber;

a pair of terminal means mounted in said connector housing member;

switch means disposed in the cavity, said switch means including a resilient switch blade electrically connected to one of said terminal means and a stationary contact support portion electrically connected to the other terminal means, said switch blade being adapted for motion between a closed position in which the switch blade engages said stationary contact support portion and an open position in which the switch blade does not engage said stationary contact support portion, said switch blade being biased in a normal operating position selected from one of said closed and open positions;

actuator means interposed between said snap-action member and the switch blade and movable generally axially of the housing upon operation of said snap-action member toward said second configuration for moving the switch blade between said normal operating position in which the switch blade is in one of said open and closed positions and a trip position in which the switch blade is in the other of said open and closed positions;

said housing comprising first and second housing members, said first housing member including first spacer means, and said second housing member including second spacer means, said first spacer means engaging said second spacer means for positioning said first and second housing members at a predetermined axial spacing, the spacing between said first housing member and said second housing member being determined by the angular orientation relative to one another of said first and second housing embers about the central longitudinal axis of the housing, and wherein the snap-action member is movable conjointly with said first housing member and said switch means is movable conjointly with said second housing member such that the spacing between said first and second housing members corresponds to the spacing between the snap-action member and said switch means;

said first housing member and said second housing member being generally annular, and wherein said first spacer means comprises at least one arcuate ramp formed as one piece with said first housing member and extending along the periphery of said first housing member, said second spacer means comprising at least one stud formed as one piece with said second housing member and projecting axially outwardly from said second housing member, the stud being disposed generally at the periphery of said second housing member and engageable with the ramp, the spacing of said first and second housing members depending on the location on the stud on the ramp.

12. A control device as set forth in claim 11 comprising at least two of the ramps circumferentially spaced along the periphery of said first housing member by flat portions of said first housing member, each ramp comprising an elongate, arcuate strip extending outwardly from a position generally flush with said first housing member to a position axially spaced from said first housing member.

13. A control device comprising:

a housing having a cavity therein and a central longitudinal axis, the housing comprising a plurality of housing members including at least an input housing member disposed generally at one end of the control device, a connector housing member disposed generally at the opposite end of the device and a switch housing member disposed between said input and connector housing members and being separate from said connector housing member;

holding means comprising a tubular sleeve adapted to receive at least a portion of all of said housing members therein, the sleeve being made of a plastically deformable material and being deformed into engagement with at least one of said housing members after reception in the sleeve of said housing members for holding said housing members in substantially fixed relation relative one another;

a diaphragm disposed in the cavity and dividing the cavity into a pair of chambers;

a control port in said input housing member opening into one of said chambers, said control port being adapted for the communication of fluid pressure into said one chamber;

a snap-action member operable between a first and a second configuration supported by the housing in the cavity, and spanning at least in part across said other chamber;

at least two terminals mounted in said connector housing member;

switch means disposed in the cavity and supported by said switch housing member, said switch means including a resilient switch blade electrically connected to one of the terminals and a stationary contact support portion electrically connected to the other terminal, said switch blade being adapted for motion between a closed position in which the switch blade engages said stationary contact support portion and an open position in which the switch blade does not engage said stationary contact support portion, said switch blade being biased in a normal operating position selected from one of said closed and open positions;

a receptor mounted on the switch housing and electrically connected to said switch means, the receptor having an opening therein receiving upper portions of the terminals therein and including resilient contact means engaged by the terminals and deflected from a relaxed position such that said resilient contact means bears against the upper portions of the terminals;

actuator means interposed between said snap-action member and the switch blade and movable generally axially of the housing upon operation of said snap-action member toward said second configuration for moving the switch blade between said normal operating position in which the switch blade is in one of said open and closed positions and a trip position in which the switch blade is in the other of said open and closed positions;

the sleeve being deformed to hold the input housing member, diaphragm, actuator means, said switch means, receptor and switch housing together in fixed relation relative to each other separate and apart from the connector housing member.

14. A control device as set forth in claim 13 wherein the sleeve is deformed to hold the input housing member and diaphragm in sealing relation with each other separate and apart from the other housing members thereby forming a subassembly which may be separately tested for leaks.

15. A control device as set forth in claim 13 wherein said receptor means comprises resilient flap means engaging the terminals, said flap means being displaced from its relaxed position by the terminals whereby said flap means is biased against the terminals for maintaining engagement with the terminals.

16. A control device as set forth in claim 15 wherein said flap means comprises first and second pairs of flaps formed integrally with the receptor, the first pair of flaps being in opposing relation and receiving one of the terminals between them with each flap engaging said one terminal.

17. A control device subassembly comprising:

a housing having a cavity therein and a central longitudinal axis, the housing comprising a plurality of housing members including at least an input housing member disposed generally at one end of the control device, and a switch housing member;

holding means comprising a tubular sleeve adapted to receive at least a portion of said housing members therein, the sleeve being made of a plastically deformable material and being deformed into engagement with at least one of said housing members after reception in the sleeve of said housing members for holding said housing members in substantially fixed relation relative one another;

a diaphragm disposed in the cavity and dividing the cavity into a pair of chambers;

a control port in said input housing member opening into one of said chambers, said control port being adapted for the communication of fluid pressure into said one chamber;

a snap-action member operable between a first and a second configuration supported by the housing in the cavity, and spanning at least in part across said other chamber;

switch means supported by the switch housing member in the cavity, said switch means including a resilient switch blade electrically connected to one of said terminal means and a stationary contact support portion electrically connected to the other terminal means, said switch blade being adapted for motion between a closed position in which the switch blade engages said stationary contact support portion and an open position in which the switch blade does not engage said stationary contact support portion, said switch blade being biased in a normal operating position selected from one of said closed and open positions;

actuator means interposed between said snap-action member and the switch blade and movable generally axially of the housing upon operation of said snap-action member toward said second configuration for moving the switch blade between said normal operating position in which the switch blade is in one of said open and closed positions and a trip position in which the switch blade is in the other of said open and closed positions the sleeve being deformed to hold the input housing and switch housing in the sleeve in a substantially fixed relationship relative to one another, the sleeve being adapted to receive a connector housing member including terminals for connecting the control device into a circuit to be controlled, the connector housing member not forming part of the subassembly, the sleeve being adapted to be deformed to hold the connector housing members in fixed relation to the input and switch housing members.

* * * * *